United States Patent [19]

Goncalves

[11] 4,094,120

[45] June 13, 1978

[54] METHOD OF MANUFACTURING A PAIR OF PLASTIC GLOVES AND PACKAGING THEM WITHIN A SHEET OF WRAPPING MATERIAL

[75] Inventor: Antonin Goncalves, Groslay, France

[73] Assignee: L'Oreal, Paris, France

[21] Appl. No.: 743,629

[22] Filed: Nov. 22, 1976

[30] Foreign Application Priority Data

Jan. 14, 1976 France ..... 76 00825

[51] Int. Cl.[2] ..... B65B 63/04

[52] U.S. Cl. ..... 53/21 FW; 53/31; 53/32; 229/87 A

[58] Field of Search ..... 53/31, 32, 33, 34, 21 FW; 206/278, 438; 229/87 A; 2/169

[56] References Cited

U.S. PATENT DOCUMENTS

| | | | |
|---|---|---|---|
| 1,645,842 | 10/1927 | Widmaier | 53/120 |
| 2,925,693 | 2/1960 | Boone | 53/117 X |
| 3,053,024 | 9/1962 | Wexler | 53/120 |
| 3,187,987 | 6/1965 | Langdon | 229/82 A |
| 3,391,855 | 7/1968 | Ansell | 206/278 X |
| 3,486,291 | 12/1969 | Nye | 53/32 X |
| 3,923,577 | 12/1975 | Baab | 206/278 X |
| 3,925,958 | 12/1975 | Heisig | 53/21 FW |

*Primary Examiner*—Othell M. Simpson
*Assistant Examiner*—John Sipos
*Attorney, Agent, or Firm*—Brisebois & Kruger

[57] ABSTRACT

Superposed sheets of plastic material are laid on sheet of wrapping material. Gloves are formed by sealing superposed plastic sheets together in the form of two gloves attached to each other at their cuffs. The pair of gloves is then cut out, one glove is folded over the other, and the gloves and wrapping sheet folded up to form a package, which is held closed by an adhesive strip.

8 Claims, 6 Drawing Figures

METHOD OF MANUFACTURING A PAIR OF PLASTIC GLOVES AND PACKAGING THEM WITHIN A SHEET OF WRAPPING MATERIAL

SUMMARY OF THE INVENTION

As is well known, plastic gloves are commonly manufactured by welding two appropriately shaped members edge to edge and cutting them out of two sheets of superposed plastic material so as to form a glove. A disadvantage inherent in this technique of manufacture, in which the gloves are made one by one and then brought together two by two so that they may be offered for sale, results from the fact that the manufacture of each pair of gloves necessarily leads to a loss of starting material in the zone of the two sheets between the outlines of the two gloves. Attempts have been made to reduce this zone of separation to a minimum by interfitting, for example, the outlines of the fingers of the two gloves positioned head to tail.

It is also known that the operation of wrapping a pair of gloves in a sheet of wrapping material represents an important fraction of the cost of the pair of gloves because of the cost of the various handling operations which do not always lend themselves well to a high degree of mechanization. In order to reduce the cost of handling the pair of gloves and facilitate this process, it has already been proposed to position beneath the two sheets of plastic material from which the pair of gloves is made, a sheet of flexible wrapping material, such as paper, for example, so that after welding and cutting out of the two gloves the latter are at least partially sealed along a welded edge to the sheet of wrapping material. This greatly facilitates wrapping, because each of the gloves is kept flat on the sheet.

The present invention proposes to add an improvement to the above described technique with respect to the manufacture and wrapping of a pair of gloves of plastic material. This improvement makes it possible, in the course of the step of manufacturing a pair of gloves, to reduce the waste of plastic material which results when the pair of gloves is cut out. In effect, in accordance with the invention, the pair of gloves is welded and cut out in such a way that the two gloves may be connected at the edges of their cuffs along a tear line, which may be a line of perforations, for example.

The present invention also proposes to reduce the cost of the step of wrapping the resulting pair of gloves, on the one hand, by using a sheet of wrapping material having a reduced size, the maximum dimensions of which correspond only to those of one of the gloves of a pair, said glove being sealed along its welded edge to said sheet and, on the other hand, by simplifying the operation of wrapping the two gloves in this sheet of wrapping material.

According to the invention the second glove is folded over the sheet of wrapping material to which the first glove is sealed so that the packaging of the pair of gloves is reduced to the simple folding of the sheet of wrapping material, which may be carried out without difficulty on a conventional machine, the package being then closed by means of an adhesive strip or label.

It is thus an object of the present invention to provide a new method of manufacturing and packaging, within a sheet of wrapping material, a pair of gloves made of plastic material, said method consisting in welding two members of appropriate shape edge to edge and cutting them out from two superposed sheets of plastic material so as to form a pair of gloves, the two sheets of plastic material being positioned initially on a sheet of flexible wrapping material, such as paper, so that after welding and cutting out the component members of the gloves, at least one of the two gloves adheres at least partially along its welded edge to the sheet of wrapping material. This method is characterized by the fact that, in the first place, the members constituting the pair of gloves are welded together edge to edge and then cut out so that the two gloves thus obtained are connected at their cuffs along a tear line, and, in the second place, the two gloves are folded over each other and, in the third place, the gloves are wrapped up in the packaging material.

In a preferred embodiment of the invention the sheet of wrapping material is only positioned beneath that part of the two superposed plastic sheets which, after welding and cutting out, constitutes a first glove adhering at least partially along its welded edge to said sheet of wrapping material. The sheet of wrapping material, the surface of which is positioned beneath the first glove has minimum dimensions which are adjusted to those of the first glove. The tear line which connects the two gloves along their cuffs is substantially positioned along an edge of the sheet of wrapping material which extends transversely with respect to the first glove. The two gloves are substantially symmetrical with respect to the tear line. After having folded the second glove onto the sheet of wrapping material to which the first glove is sealed, a first fold is made beginning at the edge of the sleeve common to the two gloves along several equidistant fold lines substantially perpendicular to the axis of the glove, and the gloves are then folded along at least one line substantially perpendicular to the fold lines of the first step. After having folded the assembly consisting of the packaging sheet and the pair of gloves which it contains, the package is closed by connecting together at least two superposed edges of the folded assembly by means of an adhesive strip or label.

In a first variation of the process according to the invention the two gloves are connected at their cuffs by each of the two layers which form the glove, the tear line being formed in each of these two layers. In this case the gloves are welded and cut out from two superposed lengths of plastic material having the same width. The tear line along the edge of the cuffs of the two gloves is formed in the two superposed sheets. This results, after the welding and cutting operation, in two gloves, connected at their cuffs, by each of their two layers.

In a second variation, the two gloves are connected at their cuffs by a single one of their two layers, in which the tear line is formed, the two separate edges of the cuff of the other layer of the gloves being, before the operation of folding the two gloves onto each other, located on opposite sides of the tear strip. In this case, the gloves are welded and cut out from a first length of plastic material on which two lengths of plastic material having a width less than half the width of the first length are positioned side by side. The tear line, such as a line of perforations for example, is formed along the median longitudinal line of the subjacent sheet, between the two edges of the two sheets beneath which the subjacent sheet is positioned. Thus there is obtained, after welding and cutting out, a pair of gloves which are connected along their cuffs only by the one of the two layers formed from the subjacent sheet. This offers, as compared with the first variation, two advantages. In the first place, there is an additional saving in plastic material and, in the second place, it facilitates the separation of the gloves at the moment of use, since the perforated line common to the two gloves is formed in only one of the two layers.

It will be appreciated that the embodiment according to the invention permits a substantial saving in plastic material since the two gloves are connected by their base along a line of perforations and there is consequently, as distinguished from the prior art technique, no waste resulting from an area of the two sheets of plastic material which is located between the outlines of the two gloves of a pair. At the moment of use the two gloves may be separated by tearing along the line of perforations.

Moreover, the packaging of the pair of gloves is carried out by means of a sheet of wrapping material having minimum dimensions which is positioned beneath the two sheets of plastic material so that a first glove adheres, after welding, along its edge to the sheet of wrapping material. The subsequent operations are particularly simple and lend themselves well to advanced mechanization of the wrapping steps. The second glove is folded onto the first and, by means of a conventional machine, a transverse fold is formed followed by a longitudinal fold. If there is only one longitudinal fold, each of the two edges of the folded assembly which is parallel to the longitudinal fold line constitutes the opening of a pocket which may be used to store a sachet of a product such as a shampoo, for example. This sachet may also be inserted, if desired, before having folded together the packaging sheet and the two gloves.

The assembly and the corresponding pockets are then closed while thus folded by an adhesive strip of label, said operation being advantageously carried out at an automated station.

It is clear that the wrapping paper on the visible surfaces of the package may be provided with indicia or advertising material. One of the advantages of this type of packaging is that the sheet of packaging material may, at the same time, serve as a wrapping material for the pair of gloves and the sachet, and also as a leaflet on which are inscribed the instructions relative to the method of use and an identification of the sachet.

It is also an object of the present invention to provide a pair of gloves made of plastic material produced in accordance with the process as above defined, said pair of gloves being characterized by the fact that the two gloves are connected at their cuffs along at least one tear line, the two gloves being of identical shape and dimensions and being symmetrical with respect to the tear line.

Finally, it is an object of the present invention to provide a package of a pair of gloves made of plastic material inside a sheet of wrapping material, such as a sheet of paper for example, characterized by the fact that it is obtained by utilizing the process above described.

In order that the object of the invention may be better understood, a preferred embodiment thereof will now be described, purely by way of illustration and example, with reference to the accompanying drawings, on which:

Figure 1:
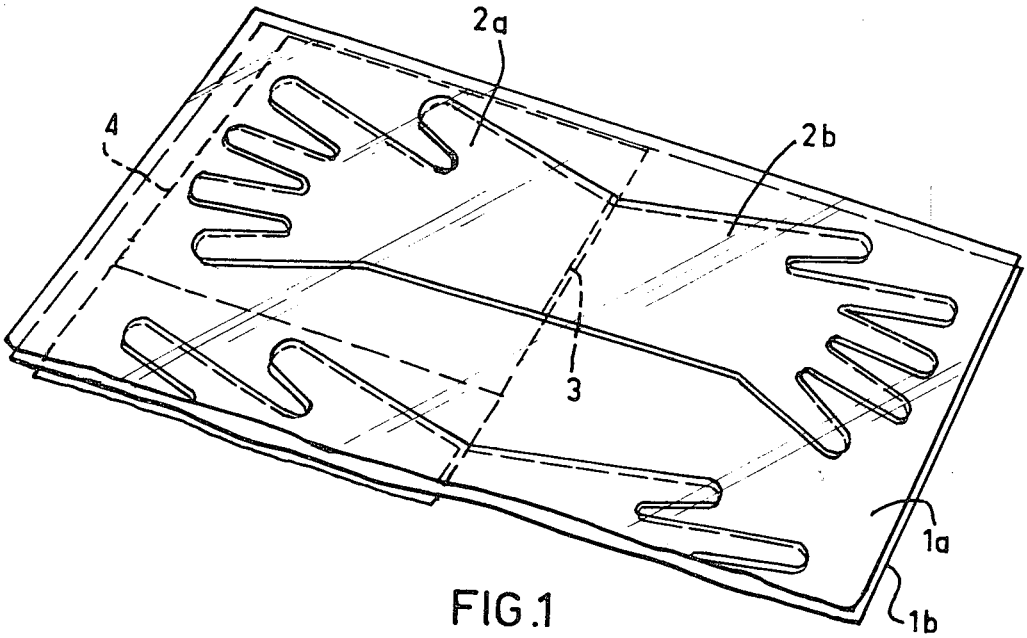
FIG. 1 shows a pair of gloves obtained in accordance with a first variation of the process according to the invention just after the step of cutting out and welding, both layers of the two gloves being connected at their cuffs.

Referring now to FIG. 1 of the drawings, it will be seen that reference numerals 1*a* and 1*b* show two superposed layers of polyethylene from which pairs of gloves 2*a*, 2*b*, are manufactured in series. Each glove 2*a*, 2*b* is obtained in a conventional manner by welding its edges and cutting out two superposed members, with the difference from the technique of the prior art that the step of welding and cutting out is carried out as shown in FIG. 1 so that the gloves 2*a* and 2*b* are connected at the level of their cuffs along each of the two layers. A perforated line 3 which forms the end of the cuffs of the gloves 2*a* and 2*b* is formed in each of their two layers. This perforated line 3 is formed of small perforations which make it possible to detach the two gloves 2*a* and 2*b* from each other at the moment of use. The perforations may be made after the operation of welding and cutting out on a conventional machine designed to produce perforated lines. Another particularity of the present invention results from the fact that, before the operation of welding and cutting, a sheet of wrapping paper 4 is positioned in the zone of the two superposed sheets 1*a* and 1*b* from the glove 2*a* is formed so that the glove 2*a* is sealed along its welded edge to the sheet of wrapping material 4.

Figure 2:
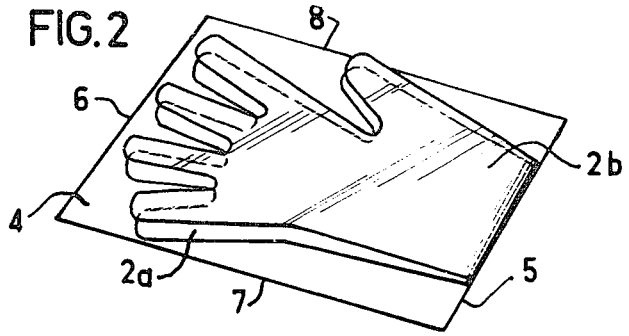
FIG. 2 shows a first step of wrapping the pair of gloves shown in FIG. 1 in which one glove is folded onto the sheet of wrapping material to which the edge of the other glove is sealed.

This wrapping sheet is, in this example, formed from a strip 268 millimeters in width. This strip is, after welding and cutting out of the pair of gloves 2*a* and 2*b*, cut transversely in order to obtain a sheet 222 millimeters by 268 millimeters. The wrapping sheet 4 has a size which is adjusted to that of the glove 2*a*, that is to say that the transverse edge 5 of the wrapping sheet which is at the side of the cuff is positioned along the edge of said cuff ultimately formed by the perforations 3 while the other transverse edge 6 which is positioned at the side of the fingers of the glove is just at the end of the longest. In like manner the little finger and the thumb of the glove 2*a* are positioned immediately adjacent the longitudinal edges 7, 8 of the wrapping sheet 4. Once the operation of welding and cutting out has been completed, the second glove 2*b* is folded over the wrapping sheet 4 to which the first glove 2*a* is sealed, as illustrated in FIG. 2. As the two gloves 2*a* and 2*b* have an identical shape and dimensions and are positioned symmetrically with respect to the perforated line 3, the welded edges of the two superposed gloves coincide.

Figure 3:
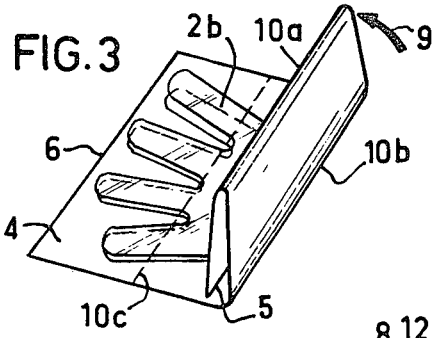
FIGS. 3 and 4 show the next two successive steps of folding the sheet of wrapping material and the pair of gloves of FIG. 1.

FIGS. 2 and 3 illustrate the step of wrapping the pair of gloves in the course of which the two gloves and the sheet of wrapping material are folded together. This step may be carried out on a conventional machine adapted to this purpose. A first transverse fold of the wrapping sheet and the two gloves is made in the direction indicated by the arrow 9. The fold is made along the three fold lines 10*a*, 10*b*, and 10*c* which are parallel and equi-distant. The wrapping sheet is first folded along the line 10*a* to bring edge 5 of the wrapping sheet against the fold line 10*b*. The line 10*a* is then folded to meet the line 10*c* by folding along the line 10*b*, and finally, the line 10*b* is brought against the edge 6 by folding along the line 10*c*.

Figure 4:
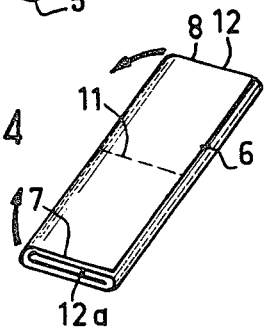

It should be noted that the simultaneous folding of the wrapping sheet and the two gloves is facilitated since the first glove 2*a* is sealed to the wrapping sheet and the second glove 2*b* which covers it is located by the perforated line 3 which connects it to the first glove which assists in maintaining the two gloves 2*a*, 2*b* flat against the sheet of wrapping material during folding. The assembly is then folded in two along a longitudinal fold line 11 as indicated in FIG. 4 so as to bring the two longitudinal edges 7 and 8 of the wrapping sheet into substantial coincidence. Once the folding has been completed, each of the longitudinal edges 7 and 8 define the opening 12, 12*a* of a pocket in which a sachet of the product, for example, a sachet for shampooing, may be slipped. A sachet may also be introduced, if desired, before transverse folding.

In order to close the folded package, one adhesively secures over the openings 12 and 12*a*, an adhesive strip 13 positioned thereacross which pinches the zone of the longitudinal edges 7 and 8 of the wrapping sheet. This adhesive strip also makes it possible to hold inside the package any sachet which may have been inserted therein.

Figure 6:
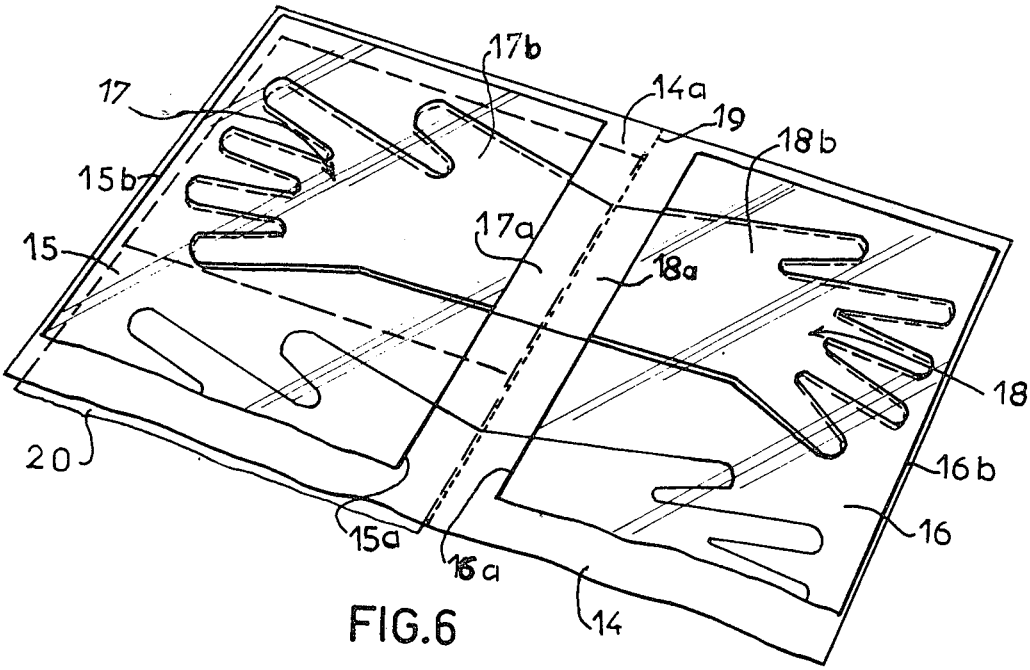
FIG. 6 shows a pair of gloves obtained in accordance with the second variation of the process according to the invention, just after the step of welding and cutting out, one layer of the two gloves being connected at their cuffs.

Referring now to FIG. 6, it will be seen that this shows a pair of gloves obtained according to a second variation of the process according to the invention, just after the step of welding and cutting out. The two gloves have the particularity of being connected at their cuffs by only one of their two layers.

In order to accomplish this a sheet of polyethylene 14 has been used, on which two sheets 15 and 16 are positioned side by side. The two sheets 15 and 16 are positioned on the subjacent sheet 14 so that their edges 15*a* and 16*a* are opposite each other defining on the sheet 14 a central strip 14*a* which is not covered since their opposed edges 15*b* and 16*b* coincide with the corresponding edges of the subjacent sheet 14. From the sheets 14, 15, and 16, thus arranged, gloves 17, 18 are welded and cut out pair by pair, so that the two gloves 17 and 18 of each pair extend in opposite directions and are connected by those of their layers 17*a* and 18*a* respectively, which have been cut from the subjacent sheet 14. The other layers of the gloves, to wit, the upper layers 17*b* and 18*b* which come from the upper sheets 15 and 16, respectively, have cuff edges formed from segments of the edges 15*a* and 16*a*. For this reason the two cuff edges of the upper layers 17*b* and 18*b* of the pair of gloves are spaced from each other by a distance equal to the width of the strip 14 between the two sheets 15 and 16.

It has been found that this second variation, as compared with the first in which the two gloves are made from two identical sheets, positioned one on the other, makes possible a saving in plastic material corresponding to the central strip 14*a*.

Figure 5:
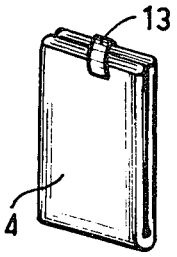
FIG. 5 illustrates the last step of the process according to the invention, in which the package, once folded up, is closed by an adhesive strip.

In order to manufacture the two gloves 17 and 18, a tear line, composed of small perforations which permit detachment of the two gloves 17 and 18 from each other at the moment of use, is formed along the longitudinal median line of the subjacent sheet 14. After separation, each glove 17, 18, has two cuff edges spaced from each other by a distance equal to that between the perforated line 19 and an edge 15*a*, 16*a* of the upper sheets 15, 16. It should be noted that the operation of separating the two gloves is facilitated since it is only necessary for the user to tear them apart along a perforated line which is formed in only one of the two layers of the gloves and not in each layer, as is the case in the first variation. As has already been indicated, a strip of wrapping paper 20 is put in place before the operation of welding and cutting out the pairs of gloves. This strip 20, the width of which is half that of the sheet 14, is positioned so that the two edges coincide respectively with the perforated line and an edge of the sheet 14. The width of the paper strip is, in this example, 268 millimeters. After welding and cutting out the gloves 17 and 18 by pairs, the gloves 17 adhere along their welded edges to the strip of paper 20. This operation having been completed, the strip of paper 20 is cut transversely into sheets 222 millimeters wide. Each sheet of paper eventually serves, as has been described in detail with respect to FIGS. 2 and 5, to package each pair of gloves 17 and 18 by folding, the folded package being then closed by an adhesive strip.

It will of course be appreciated that the embodiments hereinbefore described have been given purely by way of illustration and example, and may be modified as to detail without thereby departing from the basic principles of the invention.

What is claimed is:

1. A process of making and wrapping a pair of plastic gloves in a sheet of wrapping material comprising, the steps of, positioning at least two superposed sheets of plastic material in superposed relation to a sheet of flexible wrapping material, welding edge to edge and cutting out a flat member from said plastic sheets of an outline to form said pair of gloves connected together along a cuff region, said step of positioning further comprising positioning the wrapping material only under that part of the superposed plastic sheets which forms a first one of said gloves upon cutting and welding, adhering said first glove to said wrapping material during said step of cutting and welding, forming a weakened tear line through the cuff region of said member, folding said gloves over each other, and then folding the assembly of the wrapping sheet and the two gloves into a package.

2. Process as claimed in claim 1 in which the sheet of packaging material positioned beneath the first glove has a size which is adjusted to that of the first glove.

3. Process as claimed in claim 1 in which the tear line which connects the two gloves along their cuffs is positioned substantially along an edge of the sheet of wrapping material which extends transversely with respect to the first glove.

4. Process as claimed in claim 1 in which the two gloves are substantially symmetrical with respect to the tear line.

5. Process as claimed in claim 1 in which, after having folded said gloves over each other the gloves and wrapping material are folded along several fold lines substantially perpendicular to the axis of the gloves, and then folded along at least one line substantially perpendicular to said several fold lines.

6. Process as claimed in claim 5 in which after having folded the assembly of wrapping material and the pair of gloves which it contains, the resulting package is closed by connecting to each other at least two longitudinal edges of the assembly by means of an adhesive strip.

7. Process as claimed in claim 1 in which the two gloves are connected at their cuffs by each of two layers of material which form said gloves, a tear line being formed on each of said layers.

8. Process as claimed in claim 1 in which the two gloves are connected at their cuffs by only one of the two layers of material which form the gloves and said tear line is formed in said one layer, the two spaced cuff edges formed by the other layer of the glove being, before the two gloves are folded over each other, located on opposite sides of the tear line.

* * * * *